US006993880B2

(12) United States Patent
Cameron et al.

(10) Patent No.: US 6,993,880 B2
(45) Date of Patent: Feb. 7, 2006

(54) APPARATUSES AND METHODS FOR MANUFACTURE AND PLACEMENT OF TRUSS ASSEMBLIES

(75) Inventors: Brad S. Cameron, Longmont, CO (US); John Drozdek, Boulder, CO (US); Mark Wasinger, Arvada, CO (US); William D. Knudson, Boulder, CO (US)

(73) Assignee: Keymark Enterprises, LLC, Boulder, CO (US)

( * ) Notice: Subject to any disclaimer, the term of this patent is extended or adjusted under 35 U.S.C. 154(b) by 101 days.

(21) Appl. No.: 10/459,654

(22) Filed: Jun. 10, 2003

(65) Prior Publication Data

US 2004/0083676 A1 May 6, 2004

Related U.S. Application Data

(60) Provisional application No. 60/423,007, filed on Nov. 1, 2002.

(51) Int. Cl.
*E04C 3/02* (2006.01)

(52) U.S. Cl. ..... 52/653.2; 52/655.1; 52/656.9; 52/696; 52/702; 52/712; 52/713

(58) Field of Classification Search ..... 52/659.9, 52/653.2, 690, 696, 712, 713, 702, 289, 105, 52/693, 655.1; 403/174, 178, 217, 230; 29/897.31
See application file for complete search history.

(56) References Cited

U.S. PATENT DOCUMENTS 2,007,898 A * 7/1935 Ragsdale ..... 52/692
2,106,084 A * 1/1938 Coddington ..... 52/376
2,477,163 A * 7/1949 Barnett ..... 403/205
2,514,607 A * 7/1950 McLean ..... 52/692
3,345,792 A * 10/1967 Benson ..... 52/650.3
4,069,638 A * 1/1978 Hasselqvist et al. ..... 52/726.2
4,253,210 A 3/1981 Racicot
4,317,316 A * 3/1982 Atwood et al. ..... 52/93.1
4,435,940 A 3/1984 Davenport et al.
4,688,358 A * 8/1987 Madray ..... 52/93.2
4,817,359 A * 4/1989 Colonias ..... 52/643
5,042,217 A * 8/1991 Bugbee et al. ..... 52/643
5,054,403 A * 10/1991 Hill et al. ..... 105/419
5,457,927 A * 10/1995 Pellock et al. ..... 52/633
5,577,353 A * 11/1996 Simpson ..... 52/92.2
5,806,265 A 9/1998 Sluiter
5,857,306 A * 1/1999 Pellock ..... 52/643
5,901,522 A * 5/1999 Slater ..... 52/641
6,047,513 A 4/2000 Gibson
6,076,325 A * 6/2000 Sluiter ..... 52/655.1
6,125,594 A * 10/2000 Hudson ..... 52/92.2
6,199,341 B1 3/2001 Carlin et al.

FOREIGN PATENT DOCUMENTS

GB 2001572 A * 2/1979

OTHER PUBLICATIONS

Thomas Valve, An Ultra–Span Primer, Ultra–Span–Prefabricated Light Gauge Steel Truss System. Mar. 2000, vol. 1, Issue 7.

* cited by examiner

*Primary Examiner*—Robert Canfield
(74) *Attorney, Agent, or Firm*—Holland & Hart LLP

(57) ABSTRACT

The present invention provides for an improved method of fabricating trusses. The improved trusses are made from elongated, tubular members forming the chords and/or webs. A metal connector plate is used to connect the chords and webs to form the truss. Further, modifications of the connector plates are used to facilitate the connection of trusses into truss assemblies. Additionally, other modifications of the connector plates are used to facilitate the connection of the trusses to the supporting structure.

14 Claims, 21 Drawing Sheets

APPARATUSES AND METHODS FOR MANUFACTURE AND PLACEMENT OF TRUSS ASSEMBLIES

RELATED APPLICATIONS

The present application claims the benefit of U.S. Provisional Patent Application Ser. No. 60/423,007, titled DESCRIPTION OF THE METAL PLATE CONNECTED METAL TRUSS SYSTEM, filed Nov. 1, 2002, and incorporated herein by reference.

FIELD OF THE INVENTION

The present invention relates to truss assemblies and, more particularly, metal truss assemblies being connected by a metal connector plate.

BACKGROUND OF THE INVENTION

Load bearing structures have used trusses and the like for years. Common occurrences of trusses include the use of trusses for rooflines in residential housing, commercial space, and the like. Most common rooflines, for example, use wooden trusses joined by plates having a number of spiked protrusions, similar to nails.

More and more, metal trusses are being used instead of wooden trusses for a variety of reasons. FIGS. 1 and 2 show sample metal trusses 100 and 200. Metal truss 100 comprises a plurality of chords 102 and a plurality of webs 104. As can be seen in FIG. 1, chords 102 are made of two tubular members spaced apart to provide an area 106 between the chords 102. A portion of each web 104 resides in area 106 between chords 102. The portion of web 104 fits into area 106 such that a conventional fastener 108, such as a screw or bolt, connects web 104 and chord 102. Metal trusses of this early type are shown in U.S. Pat. No. 4,253,210, title METAL TRUSS STRUCTURE, issued Mar. 3, 1981, to Racicot, incorporated herein by reference.

One obvious deficiency with metal truss 100 is that two tubular members are necessary to form area 106 into which web 104 is placed. FIG. 2 shows another prior art, metal truss 200. Metal truss 200 comprises a plurality of chords 202 and webs 204. In metal truss 200, chords 202 are U shaped and form channel 206. Thus, instead of using a plurality of tubular members to make area 104 into which webs can be placed, each U shaped chord 202 has an open end 208 such that the sidewalls 210 of chord 202 form channel 206. Webs 204 can be placed in channel 206 and connected to U shaped chords 202 using a conventional fastener 212, such as a bolt or screw. The term U shaped chord is generically used to mean any channel shaped chord. Similar to metal truss 100, chords 202 and webs 204 are connected using a conventional fastener 212, such as a screw or bolt. Metal trusses of this type are shown in U.S. Pat. No. 4,435,940, titled METAL BUILDING TRUSS, issued on Mar. 13, 1984, to Davenport et al., incorporated herein by reference.

The trusses described above can exist as independent structures or combined into carrying trusses and carried trusses. One difficulty discovered using carried and carrying metal trusses involved stabilizing carried trusses to the carrying truss. For example, FIG. 3 refers to a truss assembly 300 having a carrying truss 302 (commonly referred to as a girder) and a plurality of carried truss 304 (commonly referred to as jacks). Carrying truss 302 and carried truss 304 each are composed of chords 306 and webs 308. As can be appreciated, placing and stabilizing carried trusses 304 prior to attachment to carrying truss 302 is difficult.

In order to facilitate manufacture and erection of truss assembly 300 by stabilizing carried truss 304 about carrying truss 302, a special metal holder 310 was developed as shown in FIG. 4. Referring specifically to FIG. 4, chords 402 and webs 404 are shown. Chords 402 are conventional metal U shaped chords having a conventional channel 406 to facilitate in joining chords 402 and webs 404. Metal holder 310 includes shop installed fasteners 408 connecting metal holder 310 to webs 404 and chord 402. Metal holder 310 has a plate hook 410 formed by a slot 412 and extension 414 on metal holder 310. Extension 414 extends into channel 406 such that a sidewall 416 on chord 402 resides in slot 412. Metal holder 310 assists to stabilize carried truss 304 until it can be connected to carrying truss 302 using field installed conventional fasteners 418, such as screws or bolts. This type of temporary holding piece is further described in U.S. Pat. No. 5,806,265, titled METAL TRUSS JOINING GUSSET, issued on Sep. 15, 1998 to Sluiter, incorporated herein by reference.

Since the development of the early metal trusses using metal U shaped chords, metal trusses have continued to use channel shaped designs to form channels by which the webs and chords can be connected. Channel shaped chords have many disadvantages, including, without limitation, a limit of the strength of the member imposed by the fact that it is channel shaped. Thus, it would be desirous to develop apparatuses and methods that would facilitate the manufacture and erection of trusses using closed tubular members instead of channel shaped chords.

SUMMARY OF THE INVENTION

To attain the advantages and in accordance with the purpose of the present invention, an improved truss assembly is provided. The improved truss assembly comprises a plurality of tubular members intersecting at one or more joints. At least one metal connector plate is provided at each joint to connect the plurality of tubular members forming the joint.

The present invention further provides methods of manufacturing and erecting individual trusses into truss assemblies. The method includes the steps of arranging the plurality of tubular members and then joining them together to form an individual truss. A metal connector plate is placed about the joint and completes the joint by connecting the tubular members. The present invention also provides an improved connection between individual trusses as is required to form truss assemblies. In particular, a metal connector plate, composed of the main plate used to connect the several tubular members at a joint, is augmented with an extension that allows for the connection of the carried truss to the carrying truss.

The present invention also provides an improved connection between a truss assembly and a load bearing structure. In particular, a metal connector plate is composed of a main plate augmented with an extension to facilitate the connection of the truss assembly to the load bearing structure.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
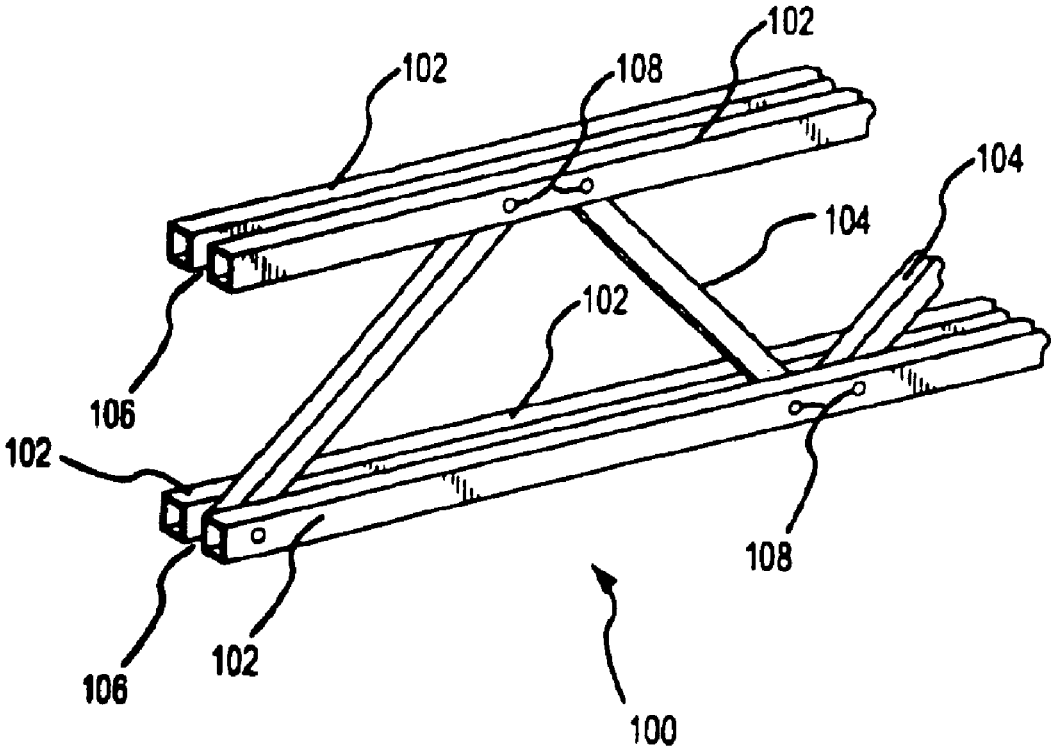
FIG. 1 (PRIOR ART)
FIG. 1 shows a perspective view of a prior art metal truss assembly.
Figure 2:
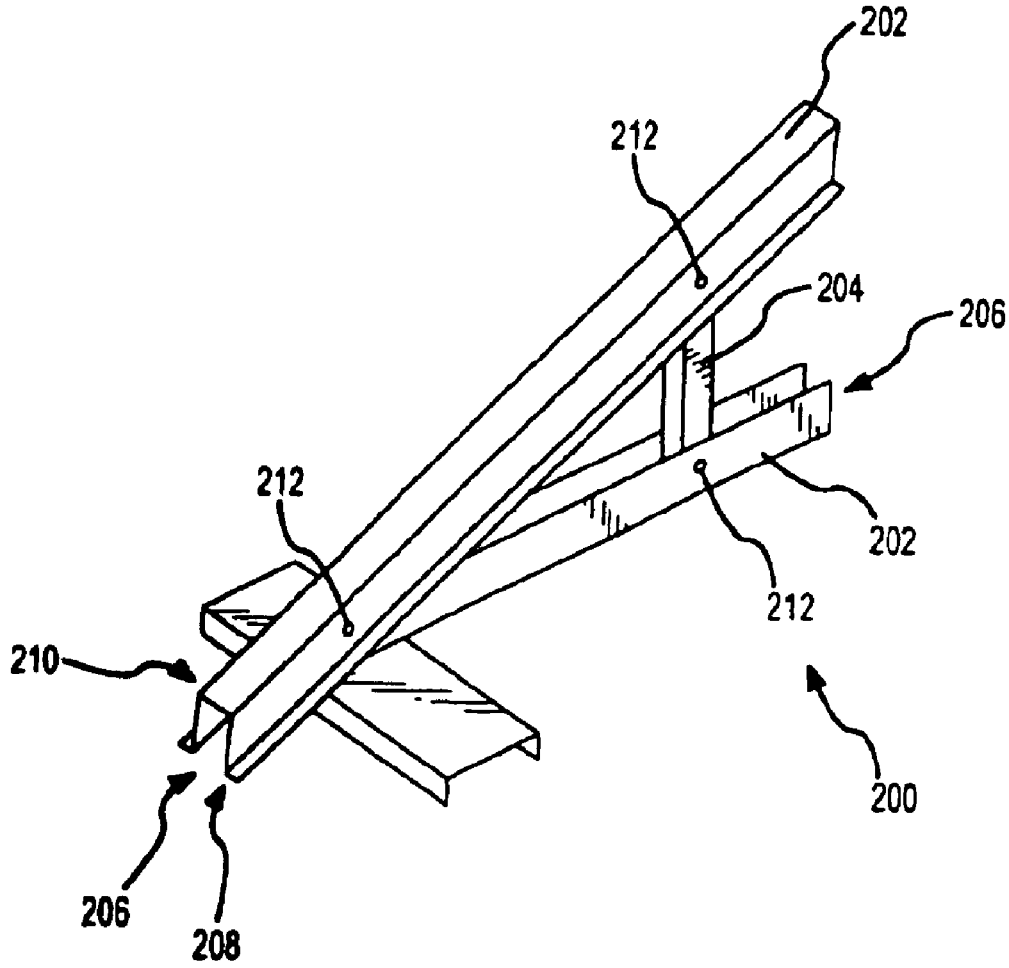
FIG.2 (PRIOR ART)
FIG. 2 shows a perspective view of another prior art metal truss assembly.
Figure 3:
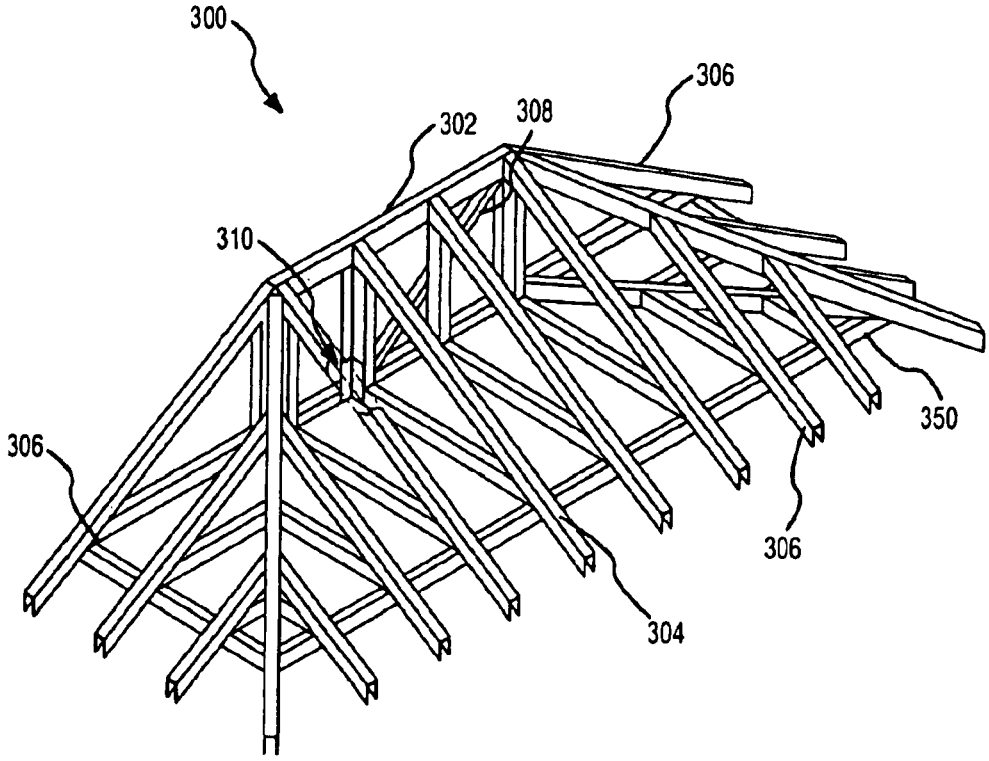
FIG.3 (PRIOR ART)
FIG. 3 shows a perspective view of a truss assembly.

The present invention will now be described with reference to FIG. 3 and FIGS. 5 to 11. Referring to FIG. 3, one of skill in the art would appreciate that truss assembly 300 is a conventional arrangement of carrying trusses and carried trusses where the carrying trusses and carried trusses are composed of chords and webs. Other arrangements and constructions are possible, including other arrangements of carrying trusses and carried trusses as well as individual truss assemblies. Truss assembly 300 is shown residing on a load bearing structure 350. Finally, while the present invention is described and illustrated with respect to truss assemblies, it should be understood the present invention is not linked to truss assemblies, but could be used in other structures, such as, for example, floor joists, wall panels, shear walls, and other structural components.

Figure 4:
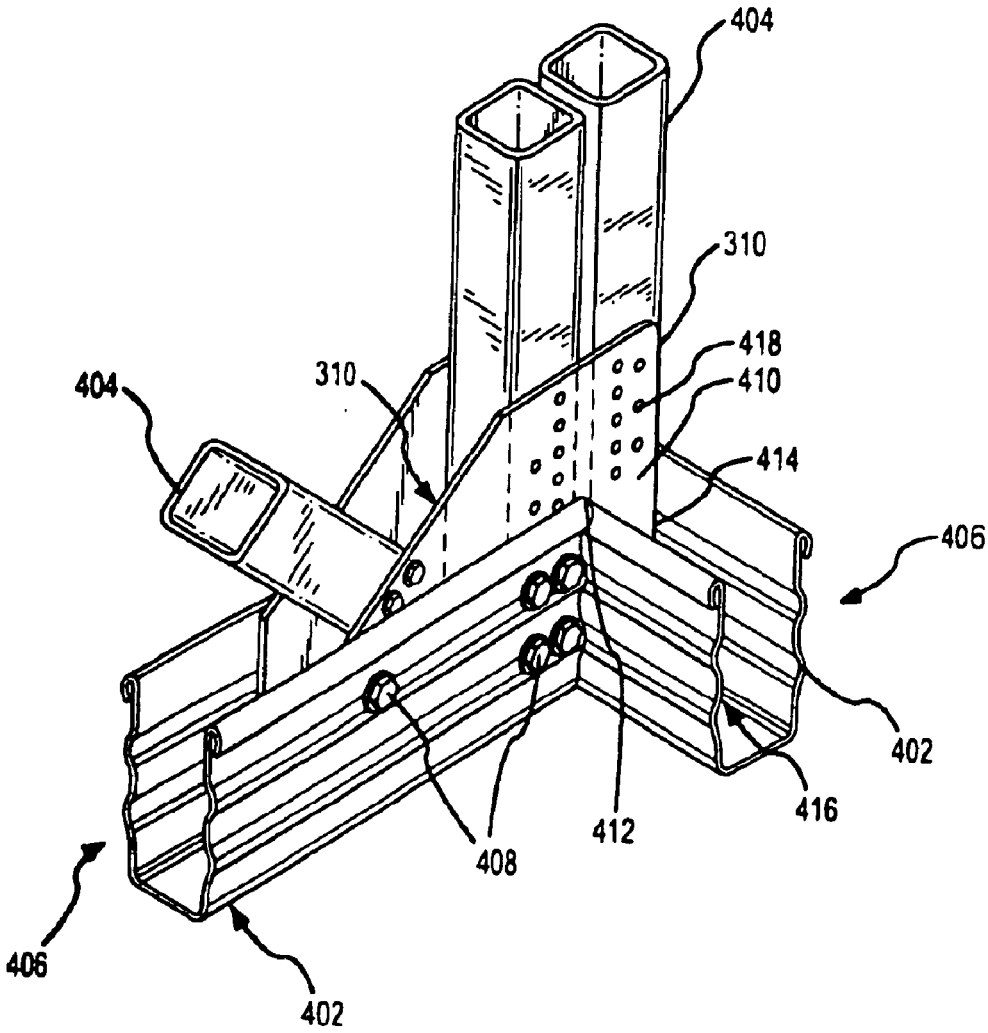
FIG.4 (PRIOR ART)
FIG. 4 shows a perspective view of a truss assembly using a metal holder to assist in the connection of chords and webs.

Conventionally, chords 306, which are channel shaped chords, and webs 308 are connected by placing the webs 308 in the channels of channel shaped chords 306 and then driving fasteners, such as screws or bolts, not specifically shown, through the several members at the joint, thus connecting the members together. While using metal holder 310 shown in FIG. 4 facilitates temporary alignment and stabilization of truss assembly 300, the placement of fasteners 408 is difficult and time consuming.

Figure 5:
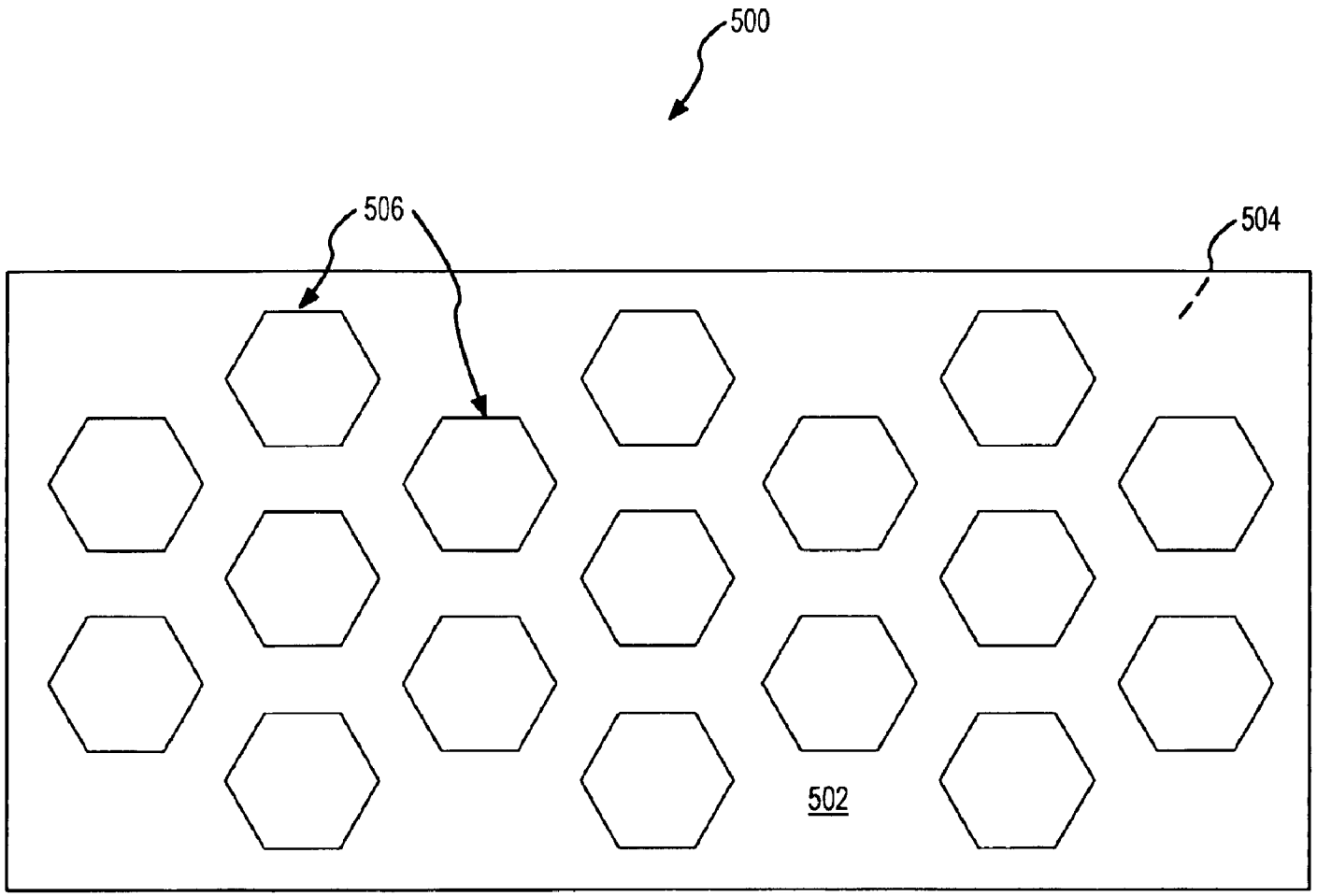
FIG. 5 shows a metal connector plate illustrative of an embodiment of the present invention.
Figure 6:
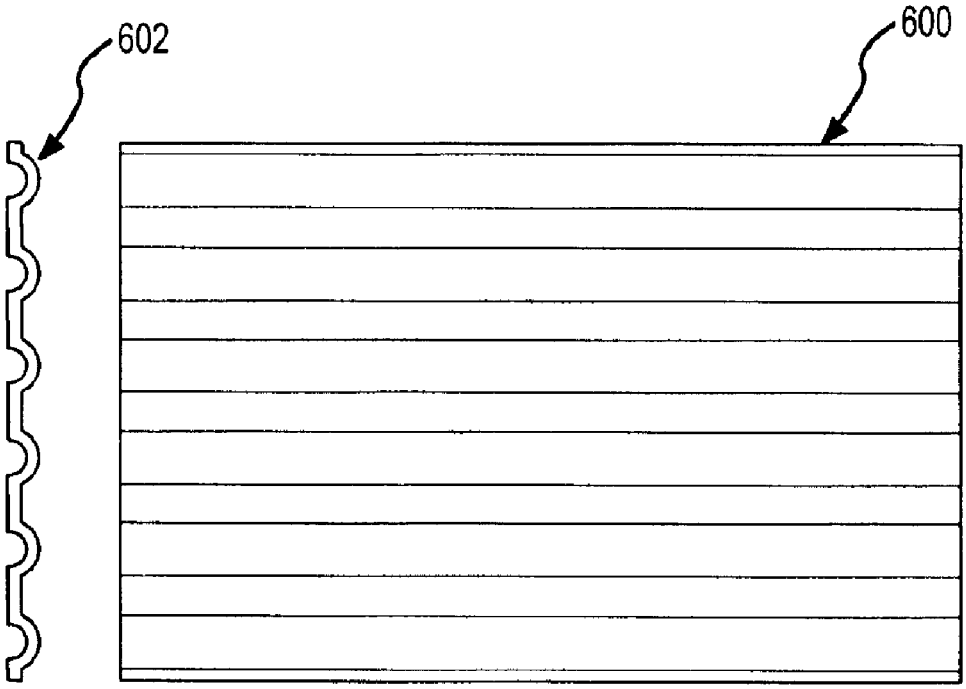
FIG. 6 shows another metal connector plate illustrative of another embodiment of the present invention.

It has been discovered, however, that metal connector plates 500 and fasteners (which fasteners are explained in more detail below) could be used to more effectively connect chords and webs. Metal connector plate 500 is shown in FIG. 5. As shown, metal connector plate has a first surface 502, a second surface 504 opposite first surface 502 and, optionally, a number of embossments 506. Metal connector plate 500 is shown as a rectangular plate, but can form any of a number of geometric shapes, such as elliptical, square, triangular, trapezoidal, or the like. Further shape 500 could be random or irregular if desired. Optional embossments 506 are shown have a hexagonal shape, but could also have other geometric, random, or irregular shapes. Embossments 506 are also shown forming a particular pattern on surface 502. This pattern is also a matter of design choice. FIG. 6 shows connector plate 600 with an alternative embossment. Metal connector plate 600 has a number of rib embossments 602 instead of hexagonal embossments 506.

Figure 7A:
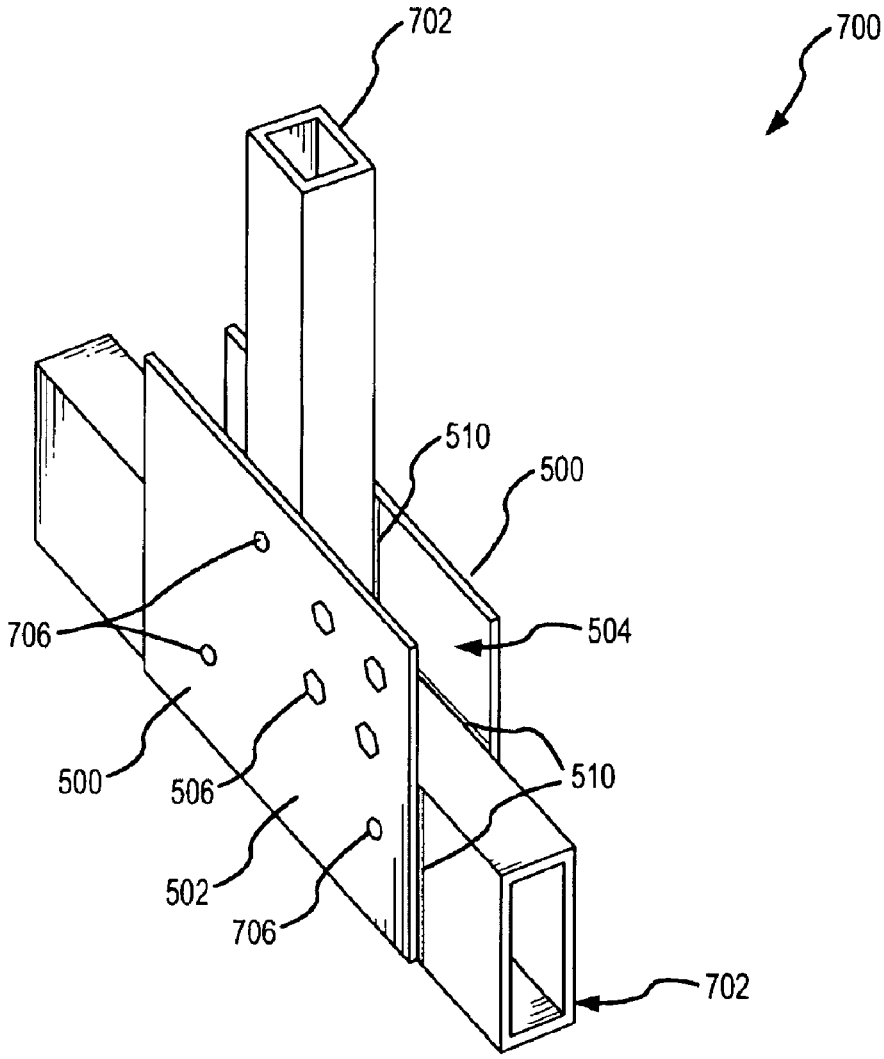
FIG. 7A shows a joint comprising chords and/or webs connected using a metal connector plate of FIG. 5 illustrative of the present invention.

Use of metal connector plate 500 will be described with reference to FIG. 7A. FIG. 7A shows a joint 700 where a plurality of elongated, tubular members 702 are attached. Elongated, tubular members 702 could be chords, webs, or a combination of chords and webs. Two metal connector plates 500 are placed at joint 700 to connect tubular members 702 using common engineering principals. While two metal connector plates 500 are shown, more or less may be used. Also, although shown as a simple connection for illustration and simplicity, one of ordinary skill in the art would recognize on reading the disclosure that other more complex connections are possible. An option is to use a single metal connector plate 753 which is folded around the two sides of the joint as shown in FIG. 7G. The single metal connector plate 753 is composed of two plates (a near plate and a far plate) similar to metal connector plate 500 connected by bridge 754 that extends between the near plate 755 and the far plate 756. In operation, metal connector plate 500 has raised embossments 506 on first surface 502 and corresponding depressions 508 (not specifically shown or labeled on FIG. 7A) on second surface 504. An adhesive layer 510 is optionally located between each metal connector plate 500 and members 702. Adhesive layer 510 may be a glue, tape, or other adhesive. While adhesive layer 510 is shown where second surface 504 and members 702 abut, adhesive layer 510 can be discretely placed between second surface 504 and members 702 and does not need to be contiguous. Thus, adhesive layer 510 can be discretely placed, placed to coat second surface 504 where second surface 504 abuts members 702, or can completely coat second surface 504.

Plate 500 is placed about joint 700 such that adhesive layer 510 is adjacent joint 700 and first side 502 is external to joint 700. One or more fasteners 706 are driven through the connector plate 500 and into members 702 to connect joint 700. Fasteners 706 may or may not be driven through embossments 506. The use of the adhesive has been shown to add strength and stability to the joint, and to assist in the retention of the fastener. While it is envisioned that fasteners 706 will comprise pins and/or nails, more conventional fasteners are possible, such as, for example, screws, bolts or welds. As mentioned, embossments 506 are optional and for certain joints, metal connector plate 500 can be un-embossed, or inverted embossments may be used.

One possible method to construct joint 700 includes arranging members 702 to form joint 700. Next, adhesive layer 510 is placed on a first side of members 702 about where the first of the two metal connector plates 500 will be located. Once the adhesive layer 510 is placed, a metal connector plate 500 is positioned and connected to members 702 using, for example, at least one pin type fastener 706. The entire structure could then be flipped over and the procedure repeated to connect the second metal connector plate 500. While this is one possible method to construct joint 700, others are possible. Moreover, adhesive layer 510 could be applied to metal connector plates 500 instead of to members 702.

Figure 7B:
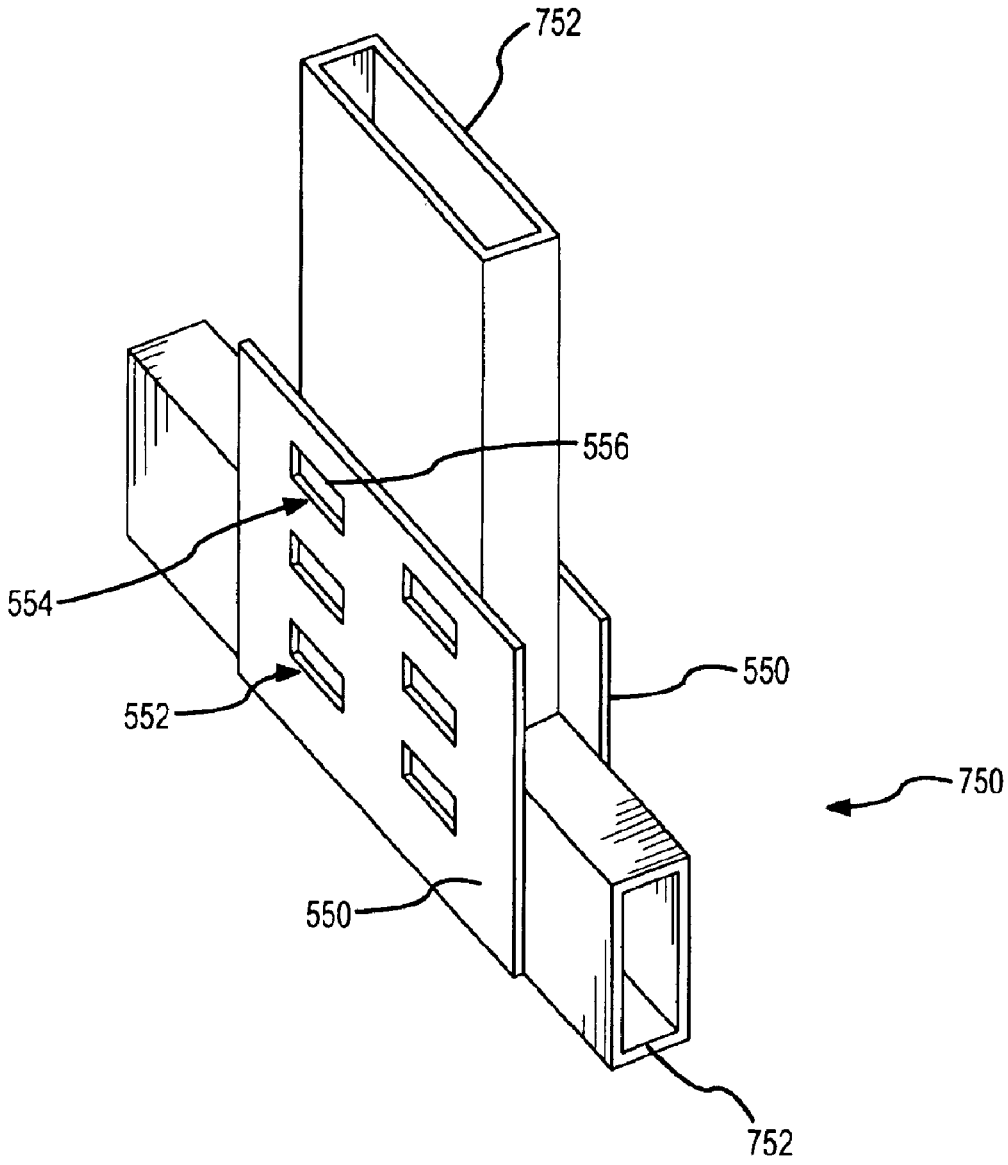
FIG. 7B shows another joint comprising chords and/or webs connected using another metal connector plate illustrative of the present invention.
Figure 7C:
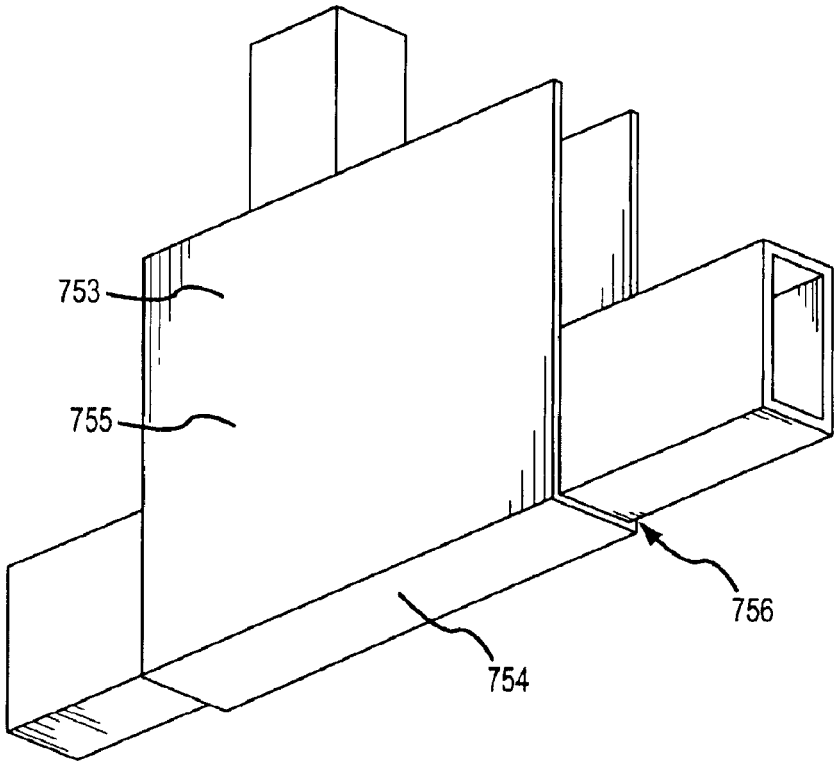
FIG. 7C shows another joint comprising chords and/or webs connected using another metal connector plate illustrative of the present invention.

As shown in FIG. 7B, an alternative metal connector plate 550 is shown. Connector plate 550 is useful for joint 750 connecting a plurality of elongated, tubular member 752. Instead of embossments, connector plate 550 has at least one slot 552 to allow for at least one groove weld type fastener 554. Some slots and welds, for example, slot and weld 556 may reside only partially over member 752. As with embossments, slots 552 could be the regular oval configuration of slots as shown or other geometric, random, or irregular shapes. Slots 552 allow for the use of welds 554 arranged in a regular pattern defined by the slots. The slots therefore impose a known, repeatable connection density throughout the connection zone defined by the intersection of the slotted connector plate and the tubular member. This is desirable in that it overcomes the limitations of welding around the perimeter of the plate.

While pins, adhesives, and plates (flat or embossed) have been found to work for various joint configurations, the embossed plate may be attached using more conventional fasteners, such as screws and bolts, without significantly increasing the size of the connector plate, but increasing the ability of the joint to withstand load.

Figure 8A:
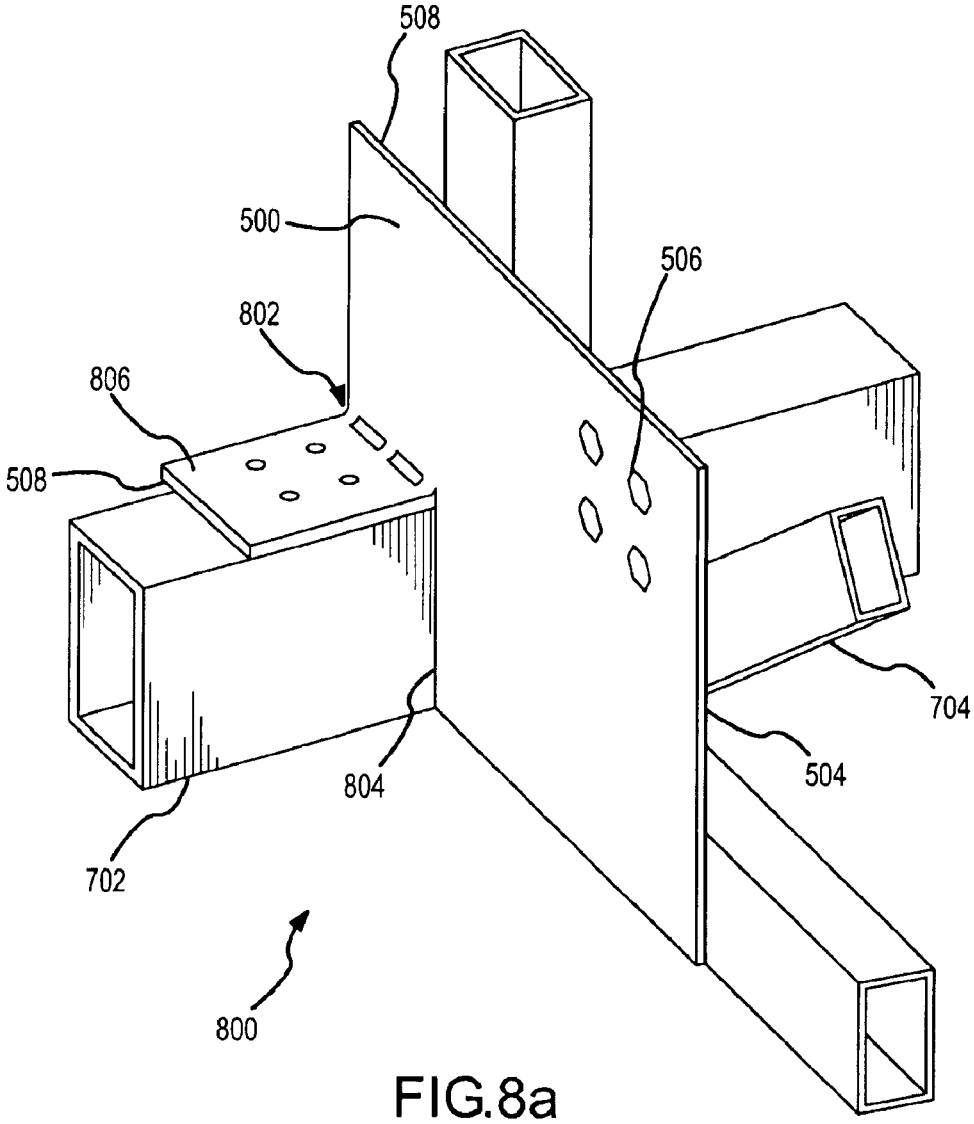
FIG. 8A shows another joint comprising chords and/or webs connected using a modified metal connector plate illustrative of the present invention.
Figure 8B:
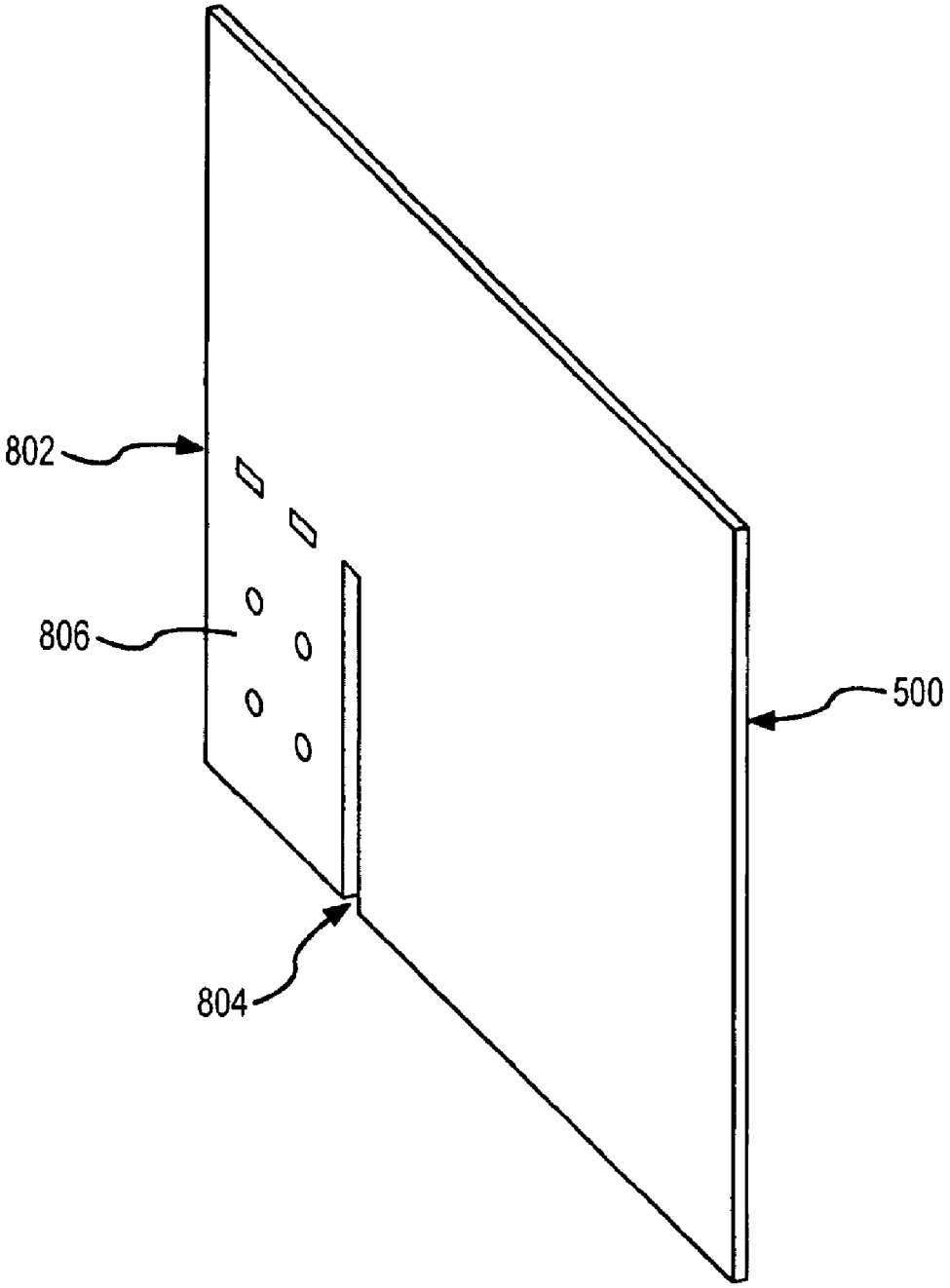
FIG. 8B shows the modified metal connector plate of FIG. 8A in an unbent configuration.

FIG. 8A demonstrates another joint 800 using a modified metal connector plate 500. Joint 800 demonstrates some of the versatility of the ability to modify a basic connector plate 500. In this case, the modified connector plate 500 has a bending line 802, a cutout portion 804, and a resulting extension 806. Bending line 802 comprises a series of slots or depressions in connector plate 500 that allows for the bending of the extension 806, an operation that typically occurs in the field. During the fabrication and shipping of the truss, the modified metal connector plate 500 can remain flat, reducing the amount of space taken up by the truss. In a flat configuration (shown in FIG. 8B), cutout portion 804 and extension 806 allow manipulation of modified connector plate 500 to fit the specifics of the joint. Cutout portion 804 bends at bending line 802 such that chord 702 fits in cutout portion 804, and cutout extension 806 fits over and can be coupled to chord 702. Otherwise, joint 800 is similar to joint 700.

Figure 9A:
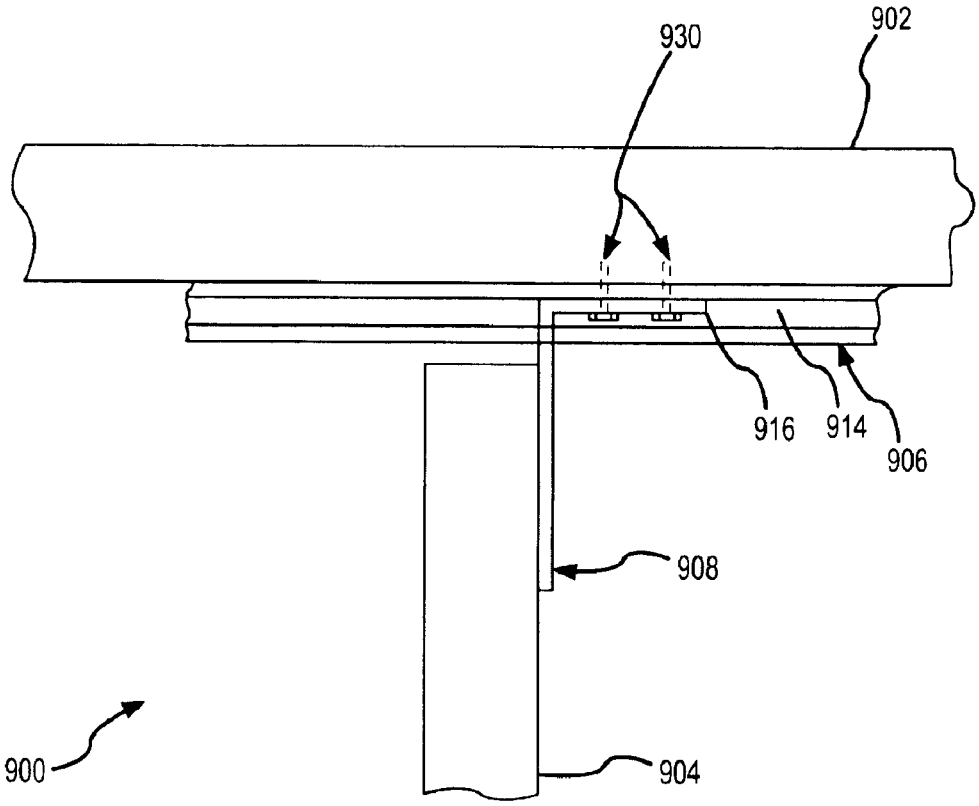
FIG. 9A is a view of a truss-to-truss connection using a modified metal connector plate illustrative of the present invention.

As described above, using metal connector plate 500 (with or without embossments, and with or without an adhesive layer), and one or more pin type fasteners 706 or an embossed metal connector plate 500 with conventional screw type fasteners provide many improvements over conventional truss assemblies; however, one difficulty is still facilitating the alignment and temporary stabilization of the carrying trusses and carried trusses. FIG. 9A shows a plan view of a connection 900 illustrative of an embodiment of the present invention capable of facilitating the stabilization. Connection 900 shows, for example, a carrying truss 902 and a carried truss 904. Carrying truss 902 has a carrying truss modified connector plate 906 attached, typically using shop installed pins, about where carried truss 904 is to be carried. This modified connector plate 906 may have the additional function of providing for the usual attachment of the tubular members 702, just as plate 500 does, as shown in FIG. 7A. Carried truss 904 has a carried truss modified connector plate 908.

Figure 9B:
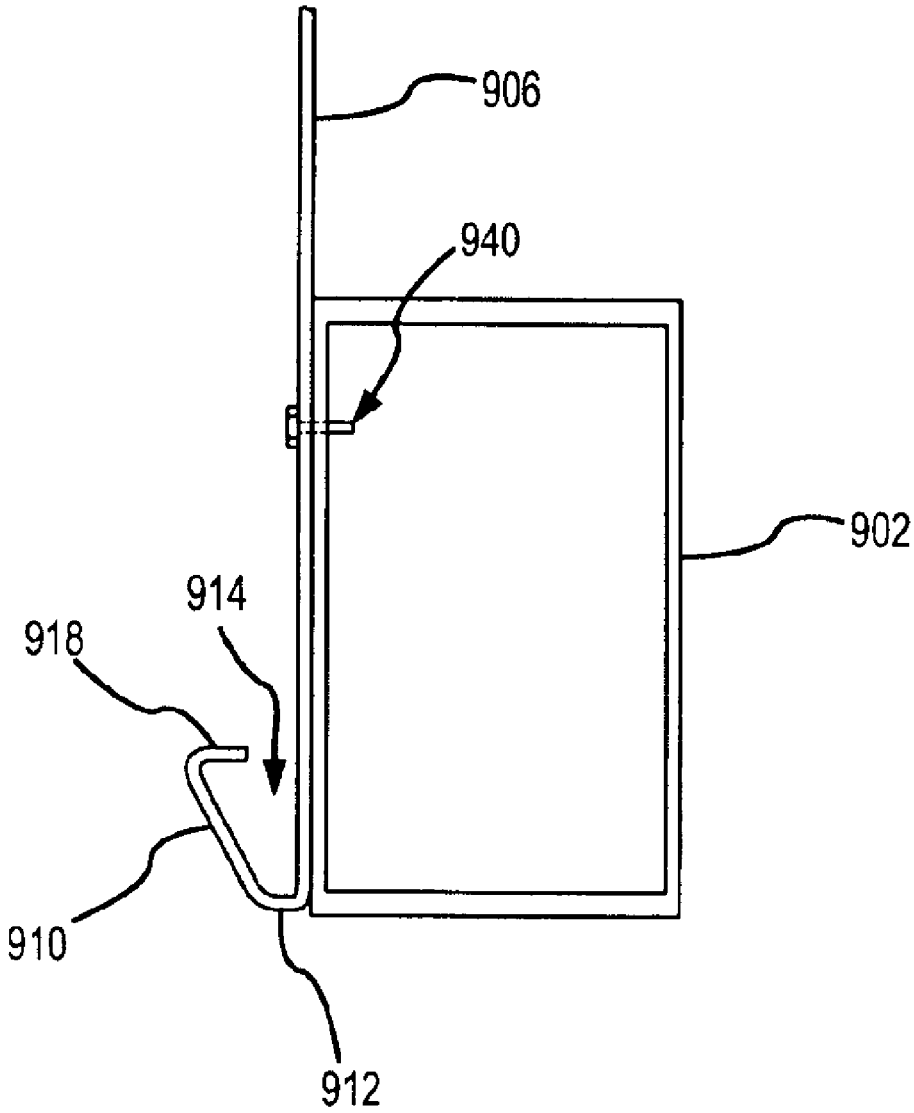
FIG. 9B is a view of the carrying truss and carrying truss modified connector plate of FIG. 9A.

Referring to FIG. 9B, an elevation drawing of carrying truss 902 and carrying truss modified connector plate 906 is shown. As can be seen, extending outwardly from carrying truss 902 is an upturned extension 910 connected to carrying truss modified connector plate 906 at a first end 912 of carrying truss connector plate 906. Upturned extension 910 and carrying truss connector plate 906 together form a groove 914. Optionally, upturned extension 910 can have a lip 918.

Figure 9C:
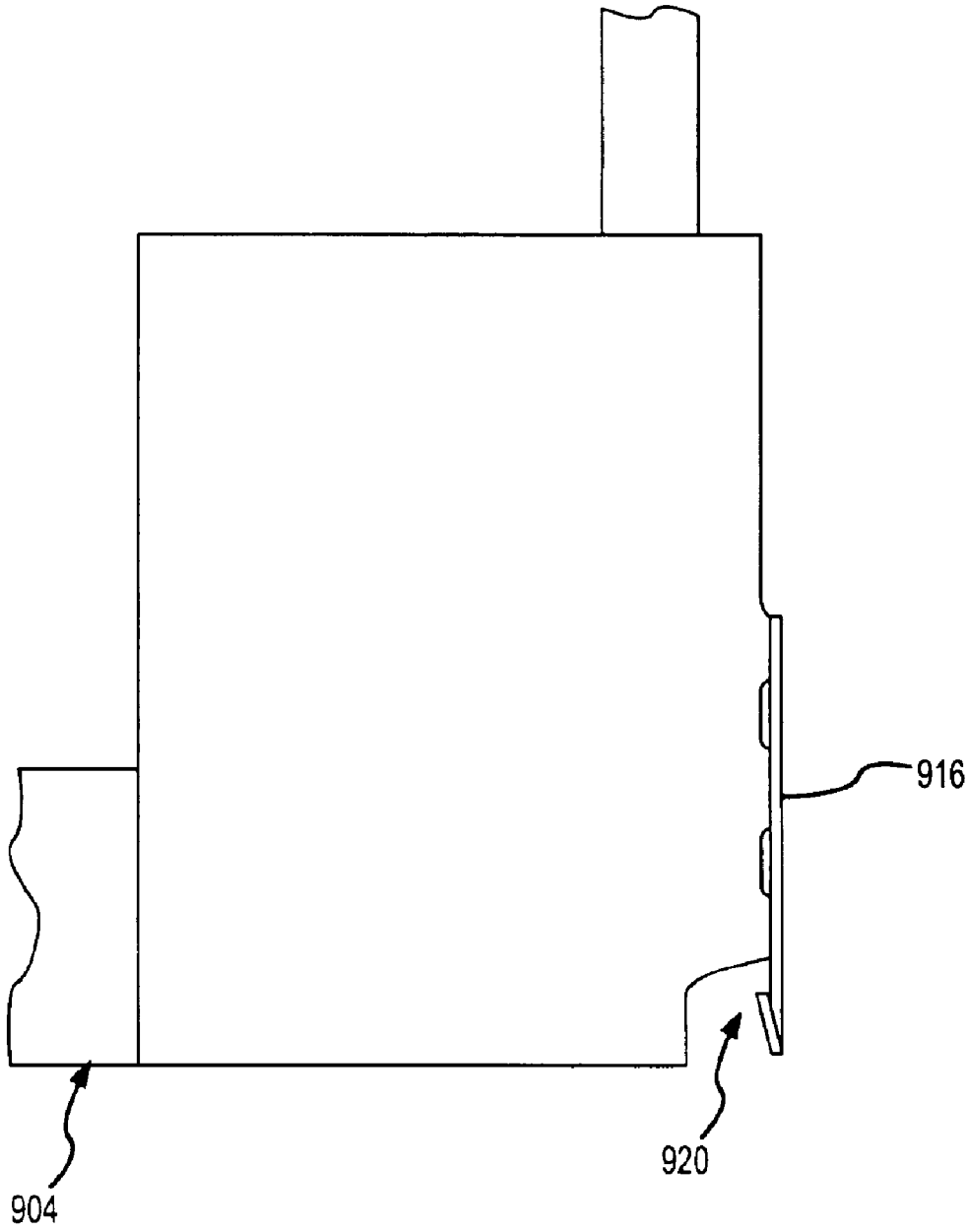
FIG. 9C is a view of the carried truss and the carried truss modified connector plate of FIG. 9A

FIG. 9C shows an elevation drawing of carried truss 904 and carried truss modified connector plate 908. Carried truss modified connector plate 908 has an outturned extension 916. Outturned extension 916 may have a barb portion 920.

Referring back to FIG. 9A, it can be seen carried truss connection plate 908 has outturned extension 916. When carried truss 904 is placed in position on carrying truss 902, outturned extension 916 fits into groove 914 to provide temporary alignment and stabilization prior to final connection. Ideally, but not necessarily, upturned extension 910 has lip 918 and outturned extension has barb 920. Barb 920 is shaped such that when placed, barb 920 of outturned extension 916 snaps into groove 914 such that lip 918 and barb 920 form a snap lock. While FIG. 9A shows the carrying truss and carried truss connection at a 90° angle, one of skill in the art would recognize on reading the disclosure that other acute and obtuse angles are possible, an example of which is shown in FIG. 9E.

Fasteners 930 shown in phantom in FIG. 9A connect carrying truss 902 and carried truss 904. Care must be used to ensure fasteners 930 do not overlap with fasteners 940 (FIG. 9B) connecting carrying truss modified connector plate 906 to carrying truss 902. In order to avoid overlapping fasteners, carrying truss connector plate 906 is marked with indicia 960 to designate zones where fasteners 930 or fasteners 940 may be connected (as shown in FIG. 9F). Indicia 960 can be lines, targets, or other placement indicators drawn or etched on a surface of carrying truss modified connector plate 906.

Figure 9D:
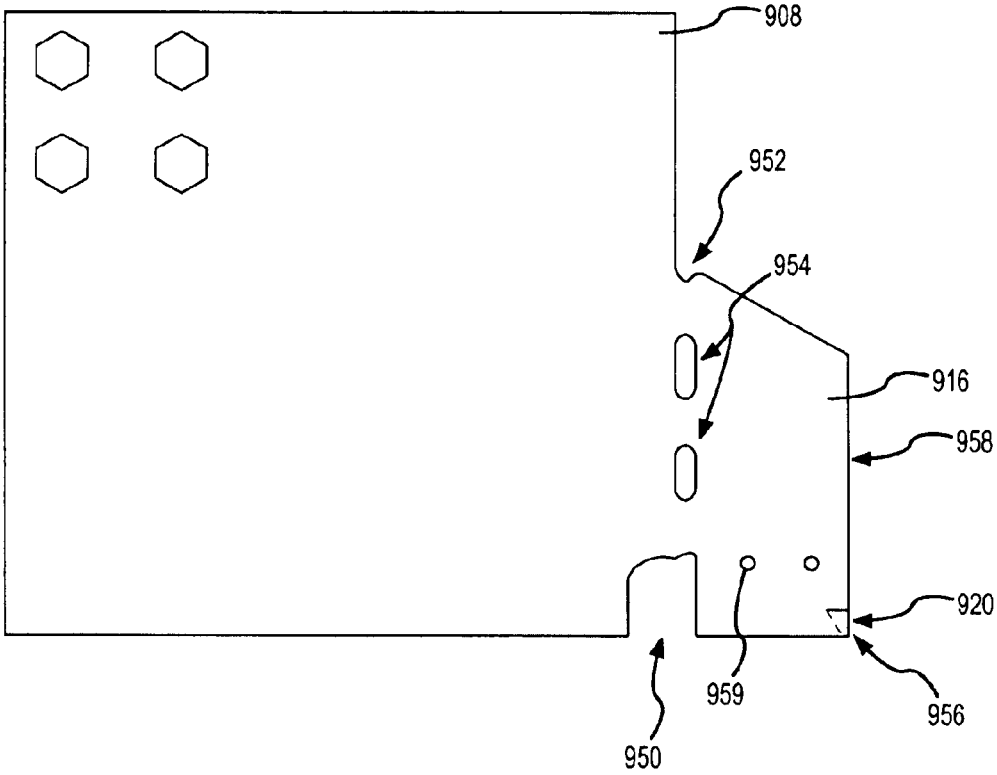
FIG. 9D is a view of the carried truss modified connector plate of FIGS. 9A and 9C in an unbent configuration.
Figure 9E:
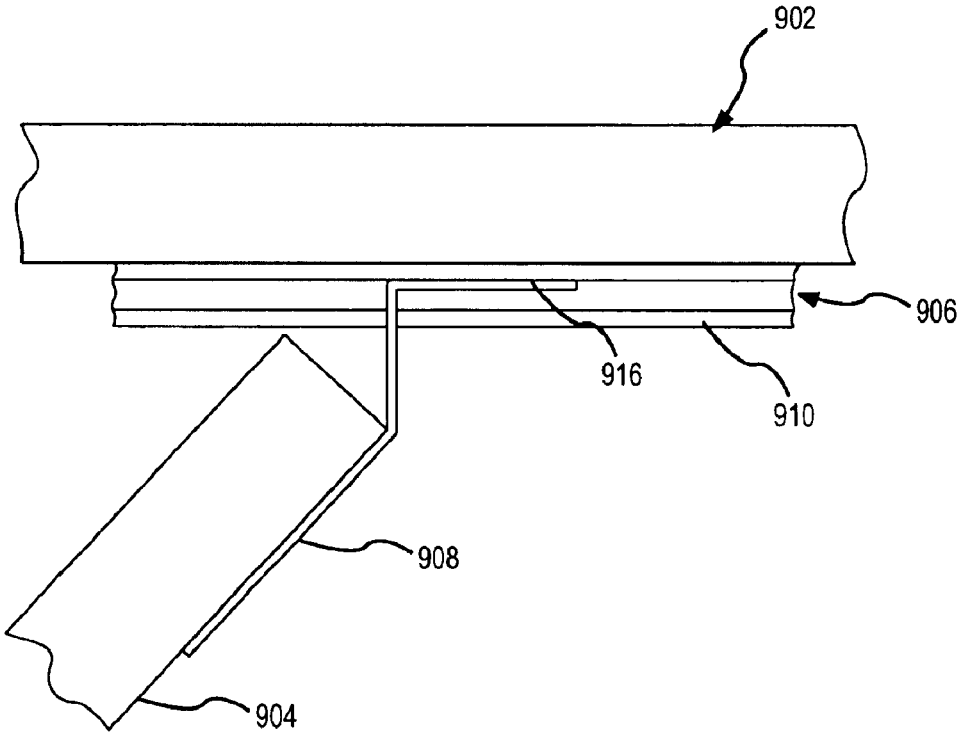
FIG. 9E is a view of another configuration for a truss-to-truss connection illustrative of the present invention.
Figure 9F:
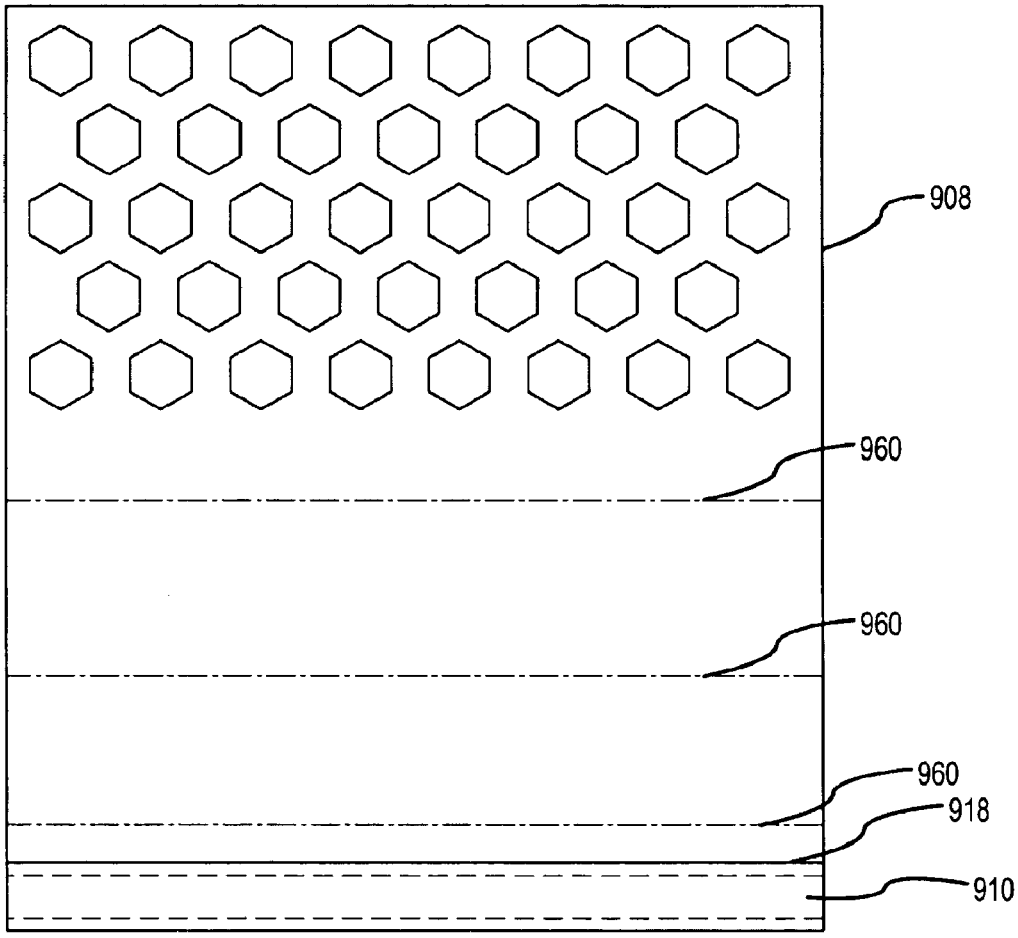
FIG. 9F is a view showing indicia on the truss connector plate of FIG. 9A.

FIG. 9D shows an unbent view of carried truss modified connector plate 908. Carried truss modified connector plate 908 contains a cutout portion 950, a bending line 952, outturned extension 916, and barb 920. Upturned extension 910 fits in cutout portion 950 when carrying truss 902 and carried truss 904 are placed for assembly. Bending line 952 has slots 954 or depressions to facilitate field manipulation of outturned extension 916. While barb 920 is shown as a turning of corner 956 on an edge 958 of outturned extension 916, barb 920 could extend over more of outturned extension 916 if desired. The barb 920 provides a temporary means of retaining the carried truss 904 relative to the carrying truss 902. However, fasteners are required to be installed at the locations specified by the pilot holes 959 found in the outturned extension 916 to provide for a permanent connection between the carried truss 904 and carrying truss 902.

Figure 10A:
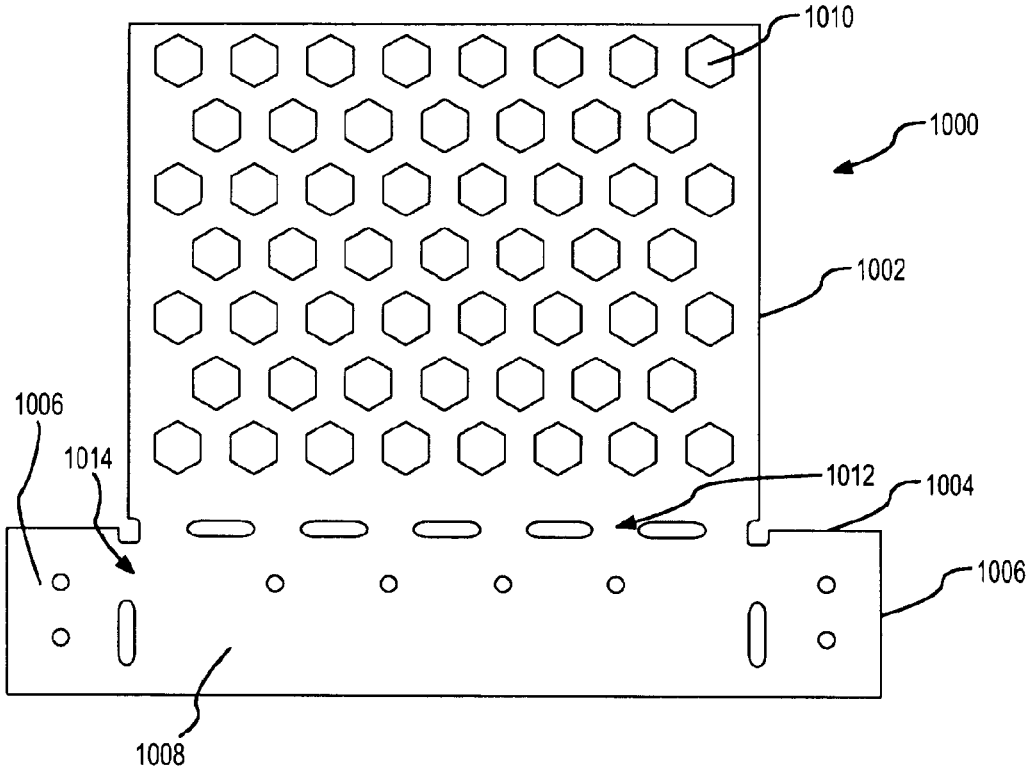
FIG. 10A is a view of the modified metal connector plate for a truss-to-structure connection illustrative of the present invention.

As mentioned above, truss assembly 300 resides on load bearing structure 350. It has been found that modified metal connector plates consistent with the present invention can also facilitate connection of assembly 300 to structure 350. In particular, FIG. 10A shows a modified metal connector plate 1000 in a flat configuration. Modified metal connector plate 1000 functions to facilitate the connection of a truss to a load bearing structure, such as truss assembly 300 to structure 350, as well as connect tubular members forming truss assembly 300. Finally, modified metal connector plate 1000 helps reinforce the tubular members against crushing or deformation at load. Modified metal connector plate 1000 has a main plate or a truss connection portion 1002 and a structure connecting portion 1004. Metal connector plate 1000 may have embossments 1010 as desired. Structure connecting portion 1004 comprises extensions 1006 and folding plate 1008. Having extensions 1006 on each side of folding plate 1008 facilitates versatility for metal connector plate 1000, because it is envisioned that only one extension 1006 will be bent and fastened to structure 350 (further described below) and the other extension 1006 will continue in an unbent state, residing in, for example, the ceiling.

Figure 10B:
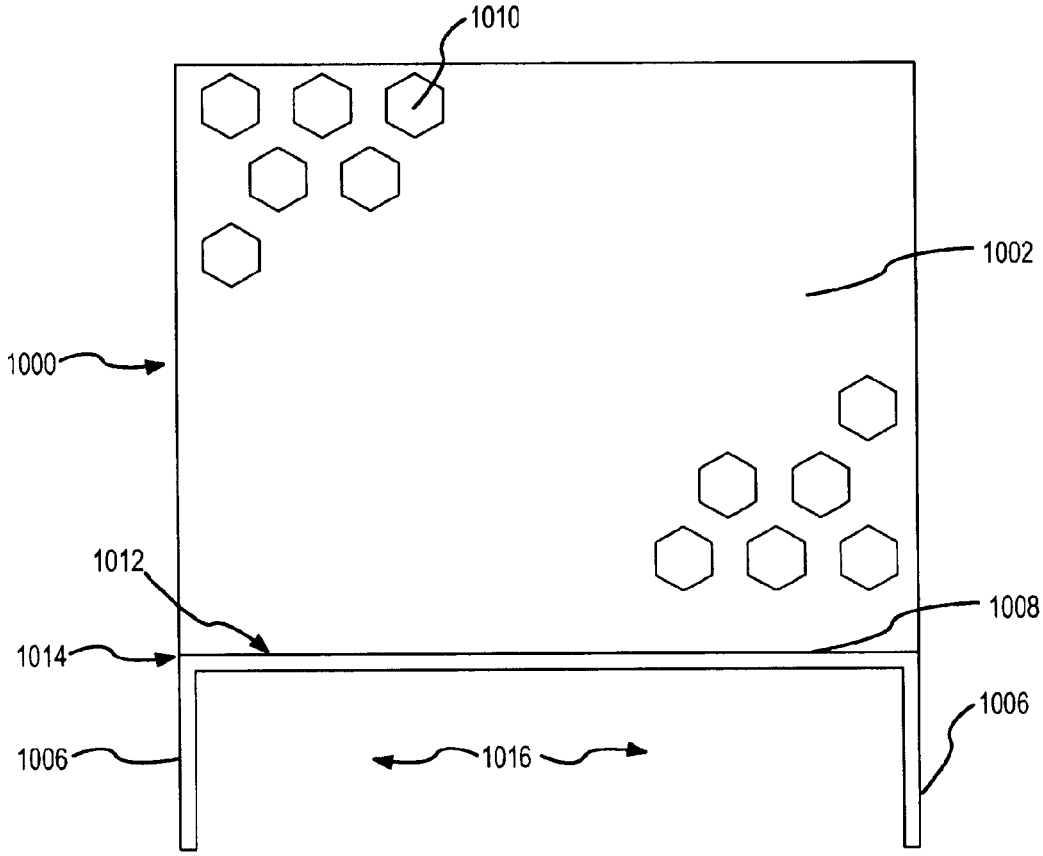
FIG. 10B is a view of the modified metal connector plate of FIG. 10A, bent into a final configuration.
Figure 10C:
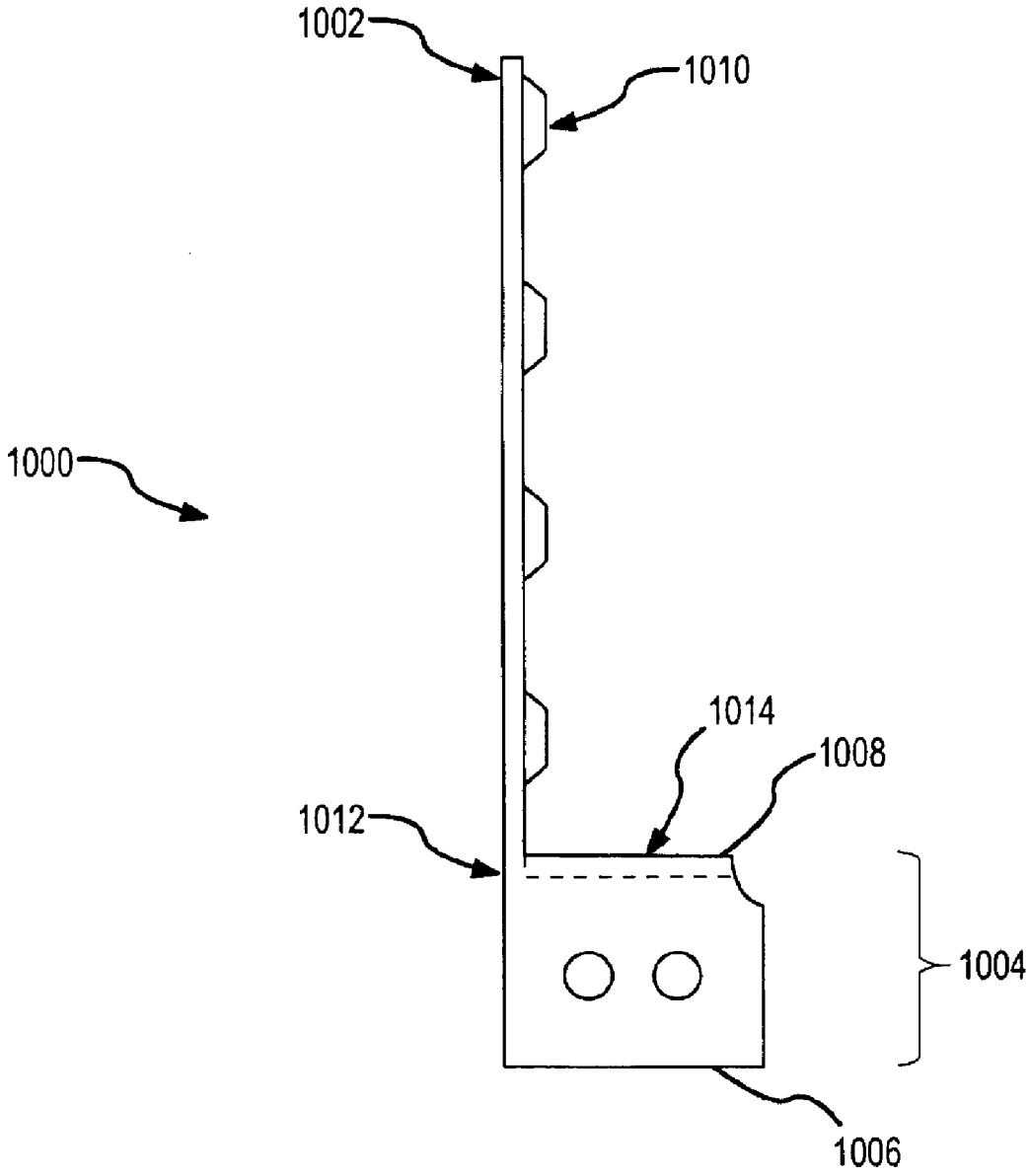
FIG. 10C is a view of the modified metal connector plate of FIG. 10B, bent into a final configuration.

Referring now to FIGS. 10B and 10C, modified metal connector plate 1000 is shown in a bent configuration. The modified metal connector plate would be bent to this configuration during the connection of this truss to its supporting structure. As can be seen, structure connecting portion 1004 is bent along lines 1012 and 1014 such that extensions 1006 and folding plate 1008 form cavity 1016. Cavity 1016 fits around load bearing structure 350 (not shown in FIGS. 10A to 10C) such that the structure connecting truss assembly portion can be coupled to load bearing structure 350 using fasteners, such as, for example, pins, screws, adhesives, glues, welds or the like and any combination thereof. Truss connecting portion 1002 could connect to tubular members in a manner explained above. While structure connecting portion 1004 is shown as capturing the entire load bearing structure in cavity 1016, only a portion of the load bearing structure needs to be captured. Thus, folding plate 1008 does not need to traverse the entire load bearing structure and extensions 1006 can be optionally removed or left in their unbent state (either one or both).

Figure 11:
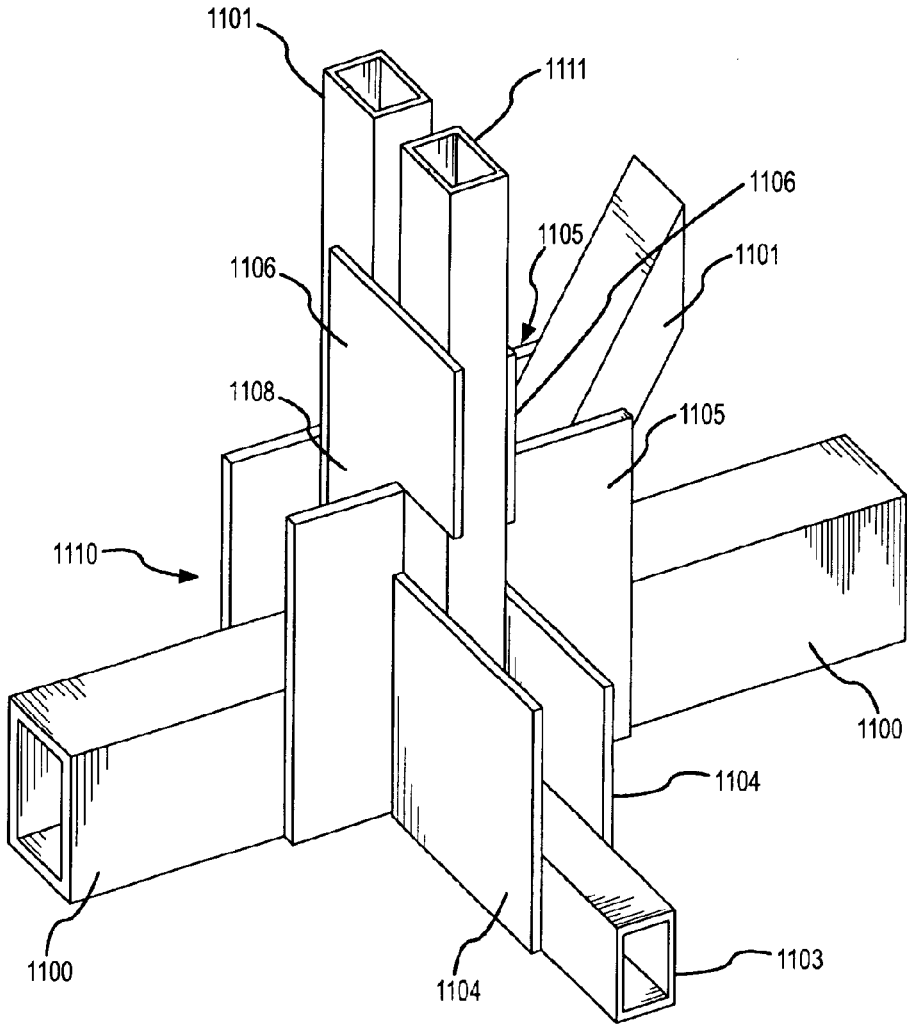
FIG. 11 is a view of an alternative stabilization plate illustrative of an embodiment of the present invention.

Referring now to FIG. 11, another feature of the present invention is shown. FIG. 11 shows a first joint comprising chord 1100 and webs 1101, forming the carrying truss, for example. Metal connector plates 1105 connect chord 1100 and webs 1101. Metal connector plates 1105 form a gap 1110. A second joint comprises chord 1103 and web 1111, forming the carried truss, for example. Metal connector plates 1104 connect chord 1103 and web 1111.

A pair of metal stabilizing plates 1106, each including a stabilizing extension 1108, connect one web 1101 of the carrying truss to one web 1111 of the carried truss. Stabilizing extension 1108 fits into gap 1110 formed by metal connector plates 1105 stabilizing the first joint, which may be part of a carrying truss, and the second joint, which may be part of a carried truss.

To facilitate the placement of the various plates and fasteners described above, the tubular members and plates may be inked, etched, scarred, indented, or otherwise marked with placement indicators similar to the indicia shown in FIG. 9F. This indicia would provide, for example, a line 960 on plate 500 to indicate the appropriate pin placement in joint 700, see FIG. 7. During the shop fabrication of the truss, it will be desirous that the fasteners 940 be installed in a zone demarcated by line 960. Then, when the outturned extension 916, attached to the carried truss 904, is placed in its proper position in the groove 914 of the carrying truss 902, the pilot holes 959 found in outturned extension 916 will facilitate the placement of fasteners through outturned extension 916, through carrying truss modified connector plate 908, and into chord member 902 in such a fashion as to not interfere with the previously installed fasteners 940. Similarly, tubular members 702 may show an ink zone specifying the placement of the metal connector plate. Ink zones can be designed with a tolerance or multiple indicia could be used to show tolerances. For example, one line could show an ideal placement zone, another line could show a marginal placement zone or tolerance range, and yet another line could show the extreme limit of a satisfactory placement of the connector plate. Other indicia are possible, such as, for example, numerical indictors for the number of fasteners for a particular connection zone, be those fasteners screws, pins, nails, welds, or the like.

The above-described invention is useful in facilitating the manufacture and placement of trusses using elongated, tubular members. However, it would be possible to use various combinations of channel shaped members as well as a matter of design choice. Further, channel shaped members could be combined to form elongated, tubular members, in other words, two channel shaped members could be combined into one tubular member.

While the invention has been particularly shown and described with reference to an embodiment thereof, it will be understood by those skilled in the art that various other changes in the form and details may be made without departing from the spirit and scope of the invention.

We claim:

1. A truss assembly including a metal connector plate useful in connecting the joints of the truss assemblies, the truss assembly comprising:

a plurality of tubular members forming at least one joint;

at least one metal plate having a first side and a second side, the second side opposite the first side;

the second side of the at least one metal plate substantially adjacent to at least a portion of each of the plurality of tubular members forming the at least one joint; and a fastener connecting the at least one metal plate to each of the plurality of tubular members forming the at least one metal joint;

the at least one metal plate includes at least one carrying plate and at least one carried plate; and the at least one carrying plate and the at least one carried plate interlock to align and stabilize the plurality of tubular members, wherein the at least one carrying plate including at least one upturned extension such that the at least one carrying plate and the at least one upturned extension form at least one groove; and the at least one carried plate including at least one outturned extension where the at least one outturned extension fitting in the at least one groove.

2. The truss assembly according to claim 1 wherein the at least one upturned extension includes at least one lip to overlap the at least one outturned extension forming at least one snap lock between the carrying plate and the carried plate.

3. The truss assembly according to claim 2, wherein the at least one outturned extension includes at least one barb, such that the at least one lip abuts the at least one barb.

4. The truss assembly according to claim 1, wherein the upturned extension and the outturned extension form at least one of a right angle, an acute angle, and an obtuse angle.

5. In a truss assembly comprising a plurality of tubular members forming a plurality of joints, the plurality of joints being connected by a connecting device, the connective device comprising:

a metal plate;

the metal plate having a first side and a second side opposite the first side;

the second side proximate at least one of the plurality of tubular members;

an adhesive layer;

the adhesive layer attached to the second side and interspersed between the second side and the plurality of tubular members; and at least one fastener connecting the metal plate to the at least one of the plurality of tubular members, wherein the metal plate comprises embossments, and wherein the metal plate comprises at least one bending line, at least one folding plate and at least one extension, wherein at least one of the at least one extension and the at least one folding plate is connected to at least one load bearing structure to form at least one truss to structure connection.

6. In a truss assembly comprising a plurality of tubular members forming a plurality of joints, the plurality of joints being connected by a connecting device, the connective device comprising:

a metal plate;

the metal plate having a first side and a second side opposite the first side;

the second side proximate at least one of the plurality of tubular members;

an adhesive layer;

the adhesive layer attached to the second side and interspersed between the second side and the plurality of tubular members; and at least one fastener connecting the metal plate to the at least one of the plurality of tubular members, wherein the metal plate comprises at least a first plate and at least a second plate;

the first plate comprising an upturned extension forming a groove; and the second plate comprising an outturned extension that fits in the groove, such that the first plate and the second plate are interlocked to provide stability.

7. In a truss assembly comprising a plurality of tubular members forming a plurality of joints, the plurality of joints being connected by a connecting device, the connecting device comprises:

a metal plate;

the metal plate having a first side and a second side opposite the first side;

the second side proximate at least one of the plurality of tubular members;

an adhesive layer;

the adhesive layer attached to the second side and interspersed between the second side and the plurality of tubular members; and at least one fastener connecting the metal plate to the at least one of the plurality of tubular members, wherein the metal plate further comprises, at least one slot; and the at least one fastener comprises a weld located substantially adjacent the at least one slot connecting the metal plate and the plurality of tubular members.

8. The connecting device according to claim 7, wherein the metal plate is embossed.

9. A truss assembly comprising at least one truss attached to a load bearing structure, the truss assembly comprising:

a plurality of tubular members; the plurality of tubular members comprising at least one of a plurality of chords and a plurality of webs;

the plurality of chords and the plurality of webs forming a plurality of truss to truss connections;

at least one load bearing structure;

the at least one load bearing structure and at least one of the plurality of chords and the plurality of webs forming at least one truss to structure connection;

at least one truss to structure connection ("TTSC") metal plate; and the at least one TTSC metal plate comprising:

a first side;

a second side opposite the first side;

at least one bending line;

at least one folding plate;

and at least one extension;

the first side and the at least one folding plate forming a first angle so the first side is aligned substantially parallel to at least one of the plurality of chords and the plurality of webs and the at least one folding plate is aligned substantially parallel to the at least one load bearing structure; and the at least one extension and the at least one folding plate forming a second angle such that the at least one extension fits around and contacts on at least one side the at least one load bearing structure.

10. The truss assembly according to claim 9, wherein at least one of the plurality of chords and the plurality of webs form at least one truss to truss connection and the at least one truss to truss connection comprises a truss to truss connection ("TTTC") metal plate, the TTTC metal plate having a first side and a second side opposite the first side and a fastener connecting the at least one metal plate to the plurality of tubular members making the truss to truss connection.

11. The truss assembly according to claim 10, wherein the TTTC metal plate further comprises an adhesive layer attached to the second side of the at least one metal plate.

12. The truss assembly according to claim 10, wherein at least one of the TTTC metal plate and the TTSC metal plate comprises at least one of an embossment, a slot, and a groove.

13. In a truss assembly comprising a plurality of tubular members forming a plurality of joints, the plurality of joints being connected by a connecting device, the connecting device comprising:

a metal plate;

the metal plate having a first side and a second side opposite the first side;

the second side proximate at least one of the plurality of tubular members;

at least one fastener connecting the metal plate to the plurality of tubular members, wherein the metal plate comprises at least a first plate and at least a second plate;

the first plate comprising an upturned extension forming a groove; and the second plate comprising an outturned barbed extension that fits in the groove, such that the first plate and the second plate are interlocked.

14. In a truss assembly comprising a plurality of tubular members forming a plurality of joints, the plurality of joints being connected by a connecting device, the connective device comprising:

a metal plate;

the metal plate having a first side and a second side opposite the first side;

the second side proximate at least one of the plurality of tubular members;

an adhesive layer;

the adhesive layer attached to the second side and interspersed between the second side and the plurality of tubular members; and at least one fastener connecting the metal plate to the at least one of the plurality of tubular members, wherein the metal plate comprises a near plate and a far plate connected by a bridge, such that at least one of the plurality of tubular members resides between the near plate and the far plate.

* * * * *